United States Patent [19]

Slack

[11] Patent Number: 5,040,971

[45] Date of Patent: Aug. 20, 1991

[54] ORIENTATION AND HEAT SETTING OVENS FOR SYNTHETIC YARNS AND FILAMENTS

[75] Inventor: Ian D. Slack, Bradford, England

[73] Assignee: Extrusion Systems Limited, Bradford, England

[21] Appl. No.: 183,932

[22] Filed: Apr. 20, 1988

[30] Foreign Application Priority Data

Apr. 22, 1987 [GB] United Kingdom ..... 8709485

[51] Int. Cl.[5] ..... F27B 9/28

[52] U.S. Cl. ..... 432/59; 432/8; 432/72; 432/152

[58] Field of Search ..... 432/72, 8, 59, 152

[56] References Cited

U.S. PATENT DOCUMENTS

| | | | |
|---|---|---|---|
| 4,116,620 | 9/1978 | Stibble | 432/59 |
| 4,217,090 | 8/1980 | Whike et al. | 432/59 |
| 4,591,517 | 5/1986 | Whipple et al. | 432/59 |
| 4,715,810 | 12/1987 | Ramsey et al. | 432/59 |

*Primary Examiner*—Henry C. Yuen
*Attorney, Agent, or Firm*—Staas & Halsey

[57] ABSTRACT

The present invention provides an oven comprising an elongate chamber with an inlet orifice at one end and an outlet orifice at the other end, via which a filament can pass through the chamber. Primary nozzles for use in introducing hot gas into the chamber are arranged, together with a gas outlet port, adjacent to the said one end of the chamber. Preferably the outlet port is nearer to the said one end than the primary nozzles. Secondary nozzles also for introducing hot gas into the chamber are arranged adjacent to the other end of the chamber. In use, hot gas is fed under pressure into the chamber via the primary and secondary nozzles against the direction of filament travel. Whilst the hot gas is fed under high pressure through the primary nozzles, the hot gas is fed at a relatively low pressure but high volume through the secondary nozzles. In this way the filament is heated all along its length in the chamber.

15 Claims, 1 Drawing Sheet

ORIENTATION AND HEAT SETTING OVENS FOR SYNTHETIC YARNS AND FILAMENTS

Figure 1:
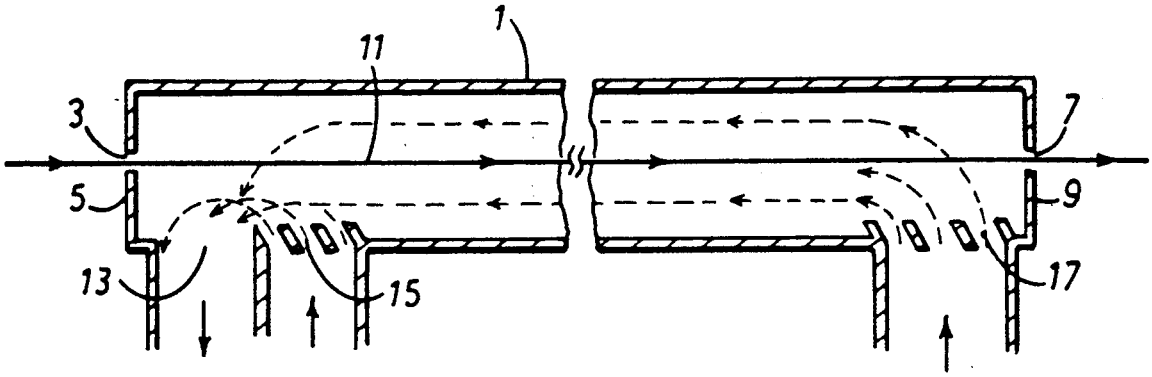

The present invention relates to an oven for use in the orientation and heat setting of synthetic yarns and filaments.

One known oven for use in the orientation and heat setting of synthetic yarns and filaments comprises and elongate enclosed chamber provided with an inlet orifice at one end and an outlet orifice at the other end. The filament or yarn being processed enters the chamber through the inlet orifice and emerges through the outlet orifice, the rate at which the filament passes through the chamber being controlled by rollers upstream and downstream of the chamber, which rollers tension and feed the filament.

Hot gas under pressure is introduced into the chamber through a series of nozzles provided towards the inlet orifice end region of the chamber and angled towards the direction of the filament flow so that a stream of hot gas impinges on the filament thereby heating it as it passes through the oven. The heated gas after impinging on the filament continues to flow along the length of the chamber parallel with the filament and leaves the chamber via a port near the outlet orifice end region of the chamber. A problem with this operation arises from the fact that the hot gas quickly reduces in temperatures after entering the chamber through the nozzles, due to the absorption of heat by the filament. The temperature of the gas also drops due to the expansion of the gas as it enters the chamber. Thus, as the gas is cooling and flowing parallel to and in the same direction as the filament, very little or no heating takes place after the filament has passed through the jets of hot gas issuing from the nozzles adjacent to the inlet orifice end of the chamber. In practice it has been found that this known type of oven operates satisfactorily at speeds up to 1000 ft/min., but above this speed insufficient heat transfer takes place to allow the process to operate.

The aim of the present invention is to provide an oven for use in the orientation and heat setting of synthetic yarns and filaments, which oven has a more efficient heat transfer capability that prior art ovens of like dimensions, whilst using similar gas temperatures and flow rates.

According to the present invention there is provided an oven for use in the orientation and heat setting of synthetic yarns and filaments, said oven comprising a chamber with an inlet orifice and an outlet orifice via which a filament can pass through the chamber, a primary inlet for use in introducing hot gas into the chamber being arranged, together with a gas outlet port, in the region of said inlet orifice, and a secondary inlet also for use in introducing hot gas into the chamber being arranged in the region of said outlet orifice of the chamber.

In the preferred embodiment of the present invention the chamber is elongate with the inlet and outlet orifices located at opposite end regions thereof, and with said gas outlet port arranged immediately adjacent to and therefore nearer to the inlet orifice end of the chamber, than said primary inlet. Further, said primary inlet and said secondary inlet are preferably formed by nozzles which are angled to direct the flow of hot gas against the direction of filament flow.

In operation the filament or yarn enters the chamber via the inlet orifice and after traversing the length of the chamber, emerges through the outlet orifice. Hot gas e.g. air, under pressure enters the chamber through said primary nozzles and impinges on the filament or yarn at a high velocity. The gas having given up its heat to the filament or yarn immediately leaves the chamber through the outlet port. A secondary flow of hot gas enters the chamber via the secondary nozzles, this secondary flow having a high volume and relatively low pressure, but being at the same temperature as the gas entering via the primary nozzle. Because of the high volume and low pressure no expansion takes place within the chamber and thus the gas remains at a constant temperature. This secondary flow of hot gas flows along the chamber against the direction of filament travel, and exits with the primary flow via the outlet port. Because the secondary gas flow is in the opposite direction to the direction of filament travel, heat is transferred to the filament during its passage along the entire length of the chamber. By using the above preferred oven, design filament speeds in excess of 5000 ft/min. can be readily achieved with efficient heat transfer, whilst using the same gas temperature and flow rates which can only achieve 1000 ft/min. in a previously known oven of the like physical dimensions.

Conveniently the hot gas used in air which can be reheated and recirculated in a closed cycle. Alternatively steam may be used.

For efficient operation, the velocity of the primary flow of hot gas is greater than the velocity of the filament as it passes through the chamber.

Figure 2:
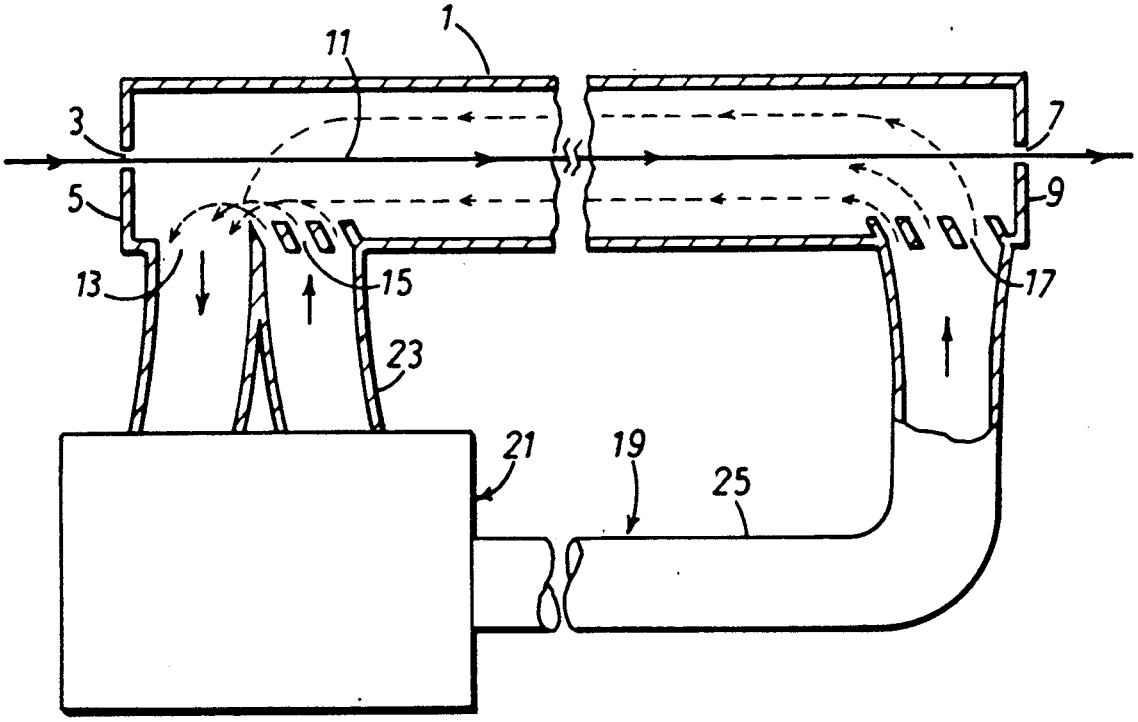

The present invention will now be further described by way of example, with reference to the accompanying drawings in which:

FIG. 1 is a schematic cross-sectional illustration of a preferred embodiment of the present invention; and FIG. 2 is a modified form of the embodiment of FIG. 1, incorporating a closed recycling system for the heated gas.

The oven constructed according to the present invention and schematically illustrated in the accompanying drawings comprises and elongate chamber 1 with an inlet orifice 3 at one end 5 and an outlet orifice 7 at the other end 9.

Immediately adjacent to the inlet orifice 5, in the side wall of the chamber 1, is a gas outlet port 13 and a primary inlet comprising a set of primary nozzles 15 is located next to said gas outlet port 13, further from said inlet orifice end 5. Adjacent to the outlet orifice end 9, in the side wall of the chamber 1, is a secondary inlet comprising a set of secondary nozzles 17. Both the primary and secondary nozzles 15,17 are angled to direct a flow of hot gas towards the inlet orifice end 5 of the chamber 1.

In use a filament(s) or yarn(s) 11 enters the chamber 1 via the inlet orifice 3 and passes along the chamber 1 to exit via the outlet orifice 7. The filament or yarn 11 is fed and tensioned by rollers (not shown) located upstream and downstream of the chamber.

Hot gas i.e. hot air, is fed under pressure through the primary nozzles 15 and directed against the direction of filament travel, to impinge on the filament. Ideally, for efficient operation, the velocity of the primary air flow is greater than the velocity of the filament. Heat from this primary air flow is thus imparted to be filament and the cooled gas exists from the chamber 1 via gas outlet port 13. Hot gas is also fed into the chamber 1 via the secondary nozzles 17, throught this secondary flow is a high volume, relatively low pressure feed. Due to the relatively low pressure and high volume, the secondary air flow does not expand so as to reduce its temperature. Thus this secondary air flow maintains a substantially constant temperature as it flows along the chamber 1 against the direction of filament travel, this secondary air flow leaving the chamber 1 with the primary air flow via the gas outlet port 13. Heat is thus transferred to the filament 11 during its passage throught the entire length of the chamber 1.

Whilst the hot gas is preferably air which can be reheated and recirculated on a closed system 19 (see FIG. 2), steam or another desired gas can be alternatively used.

In the closed system 19 of FIG. 2, a heating and pumping unit 21 is provided, said unit 21 being connected to the primary nozzles 15 by a duct 23, and to the secondary nozzles 17 by a duct 25. The ducts 23,25 and primary and secondary nozzles 15,17 are designed and dimensioned so that the heated gas from unit 21 issues from the primary nozzles 15 at a higher pressure than from the secondary nozzles 17, with a greater volume of gas issuing from the secondary nozzles 17 than from the primary nozzles 15. This produces the desired effect previously mentioned.

With the above described oven it has been found that filament speeds of in excess of 5000 ft/min. can readily be achieved with efficient heat transfer being obtained, whilst the same gas temperature and flow rates are used as in prior ovens of the same physical dimensions wherein only one speed of 1000 ft/min. can be satisfactorily obtained.

The present invention thus provides a more efficient oven for use in the orientation and heat setting of synthetic filaments and yarns, as compared to prior ovens of this kind.

I claim:

1. An oven for use in the orientation and heat setting of synthetic yarns and filaments, said oven comprising:

a chamber having an inlet orifice for introducing a filament movable through the chamber and an outlet orifice for removing the filament, a primary gas inlet for introducing hot gas into the chamber and a gas outlet port, the primary gas inlet and the gas outlet port being disposed adjacent, said inlet orifice, and a secondary inlet also for introducing hot gas into the chamber and being disposed adjacent said outlet orifice of the chamber.

2. An oven according to claim 1, wherein the chamber is elongated with the inlet and outlet orifices located at opposite end regions thereof, and with said primary inlet and said gas outlet port arranged immediately adjacent to the inlet orifice end of the chamber, with said gas outlet port arranged nearer to the inlet orifice end of the chamber than said primary inlet.

3. An oven according to claim 1, wherein said primary and secondary inlets are arranged to, in use, direct a flow of hot gas generally against the direction of filament flow through the chamber.

4. An oven according to claim 1, wherein said primary and secondary inlets each comprise a number of nozzles.

5. An oven according to claim 1, wherein said primary inlet is connected to a source of heated gas and said secondary inlet is connected to a source of heated gas, the gas issuing through both of said inlets being at a constant temperature.

6. An oven according to claim 5, wherein a higher volume of gas at a lower pressure, is fed via said secondary inlet as compared to the gas fed via said primary inlet.

7. An oven according to claim 1, wherein the oven incorporates a closed system for recycling the gas from the gas outlet port back to said inlets.

8. An oven for use in orientation and heat setting of synthetic yarns and filaments, said oven comprising an elongate chamber with an inlet orifice at one end and an outlet orifice at the other end, via which a filament can pass through the chamber, primary nozzles for use in introducing hot gas into the chamber being arranged adjacent to said one end of the chamber, together with a gas outlet port, and secondary nozzles also for use in introducing hot gas into the chamber, being arranged adjacent to the other end of the chamber.

9. An oven for use in the orientation and heat setting of synthetic yarns and filaments, said oven comprising:

an elongated chamber having opposite axial ends, a filament inlet orifice at one axial end for introducing a synthetic filament and a filament outlet orifice at the opposite axial end for removing the synthetic filament after passing through the elongated chamber;

a primary inlet adjacent the filament inlet orifice for introducing hot gas into the chamber in a flow direction substantially towards the filament inlet orifice;

a gas outlet port adjacent the filament inlet orifice; and a secondary inlet adjacent the filament outlet orifice for introducing hot gas into the chamber in a flow direction substantially towards the filament inlet orifice.

10. An oven according to claim 9, wherein said primary inlet and said gas outlet port are disposed immediately adjacent to the inlet orifice end of the chamber, said gas outlet port being arranged nearer to the inlet orifice end of the chamber than said primary inlet.

11. An oven according to claim 9, wherein said primary and secondary inlets are angled to direct a flow of hot gas generally against the direction of filament flow through the chamber.

12. An oven according to claim 9, wherein said primary and secondary inlets include louvers for directing the flow of hot gas.

13. An oven according to claim 9, wherein said primary inlet is connected to a source of heated gas and said secondary inlet is connected to a source of heated gas, the gas issuing through both of said inlets being at a constant temperature.

14. An oven according to claim 13, wherein a higher volume of gas at a lower pressure, is fed via said secondary inlet as compared to the gas fed via said primary inlet.

15. An oven according to claim 9, wherein the primary and seconday inlets are formed in an wall of the elongated chamber.

* * * * *